United States Patent [19]

Crowley

[11] 4,276,749

[45] Jul. 7, 1981

[54] STORAGE SYSTEM FOR LIQUEFIED GASES

[75] Inventor: Ralph P. Crowley, Bountiful, Utah

[73] Assignee: Phillips Petroleum Company, Bartlesville, Okla.

[21] Appl. No.: 140,904

[22] Filed: Apr. 16, 1980

[51] Int. Cl.[3] ..... F17C 7/02

[52] U.S. Cl. ..... 62/51; 62/54; 62/55

[58] Field of Search ..... 62/50, 51, 54, 55

[56] References Cited

U.S. PATENT DOCUMENTS

| | | | |
|---|---|---|---|
| 2,790,307 | 4/1957 | Ayres | 62/54 |
| 3,059,441 | 10/1962 | Werner | 62/51 |
| 3,242,681 | 3/1966 | Shaievitz | 62/51 |
| 3,302,418 | 2/1967 | Walter | 62/55 |
| 3,303,660 | 2/1967 | Berg | 62/55 |
| 3,345,827 | 10/1967 | Karbosky | 62/55 |
| 3,714,790 | 2/1973 | Battey | 62/54 |

*Primary Examiner*—Ronald C. Capossela

[57] ABSTRACT

In a storage system for liquefied gases at least a portion of the compressed gases from the refrigeration system for the storage system are combined with liquefied gases being removed from the storage system to thereby provide heat to liquefied gases being removed from the storage system. This prevents the build up of the light components of the liquefied gases in the storage system and also conserves energy.

11 Claims, 1 Drawing Figure

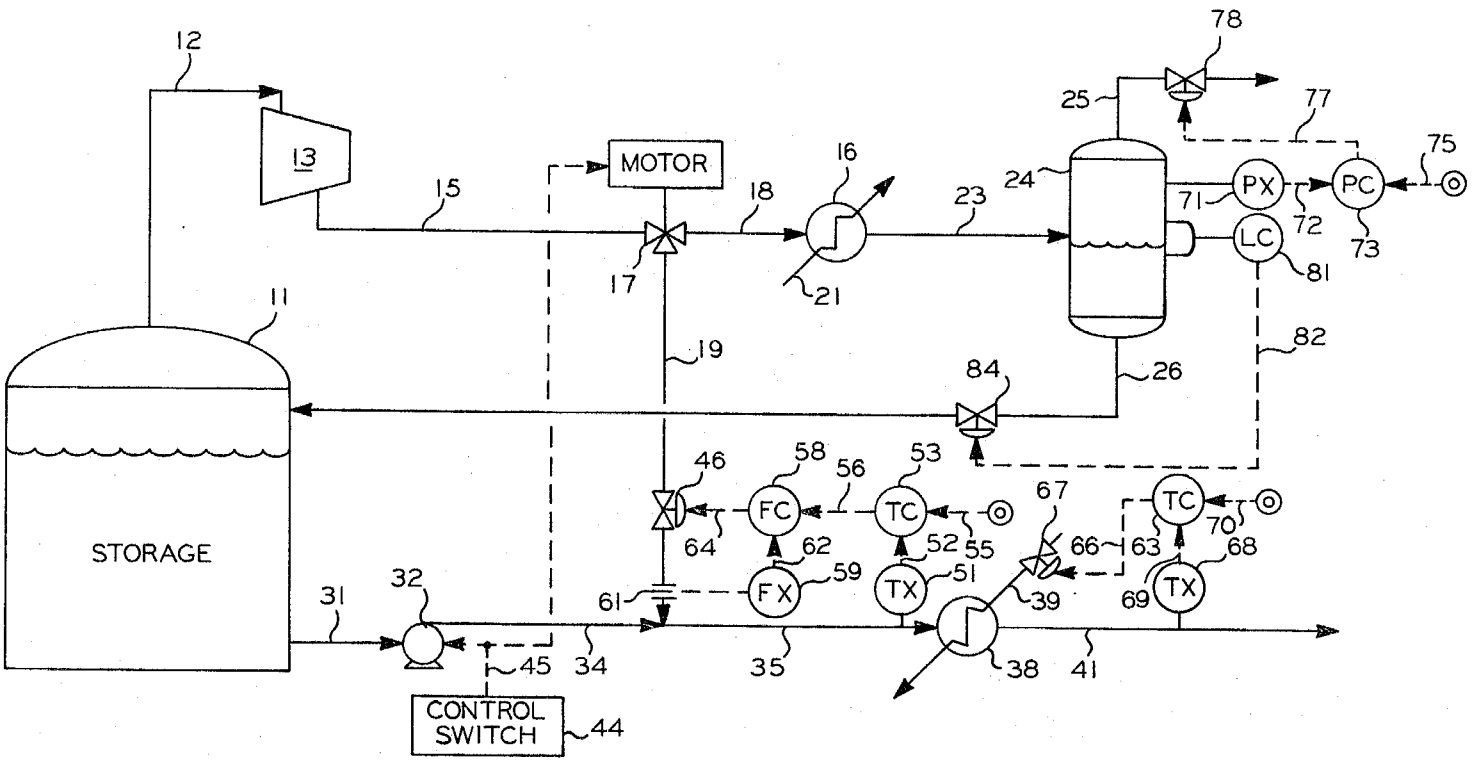
STORAGE
MOTOR
CONTROL SWITCH
PC
PX
LC
TC
TX
FC
FX

STORAGE SYSTEM FOR LIQUEFIED GASES

This invention relates to storage systems for liquefied gases. In one aspect this invention relates to method and apparatus for conserving energy during the transfer of liquefied gases from storage. In another aspect this invention relates to method and apparatus for preventing the build up of the lighter component of liquefied gases in the storage system.

Gases are commonly stored in liquefied form. Refrigeration is generally provided by removing vapors from the storage system and compressing the thus removed vapors. The compressed vapors, which have a substantially increased temperature, are cooled and the liquid portion of the compressed vapors is returned to storage. Upon return to storage, a portion of the liquid will flash to vapor to provide refrigeration for the storage system.

Liquefied gases removed from the storage system must generally be heated to prevent damage to the loading lines. This is generally accomplished simply by passing the liquefied gases through a heat exchanger which is provided with a heating fluid. However, the use of a heating fluid to heat the liquefied gases flowing from storage results in a considerable expenditure of energy which is undesirable if it can be avoided. Further, the removal of the liquefied gases from storage generally results in a build up of the lighter components of the liquefied gases in the storage area. This is also undesirable.

It is thus an object of this invention to provide method and apparatus for conserving energy during the transfer of liquefied gases from storage. It is another object of this invention to provide method and apparatus for preventing the build up of the lighter components of liquefied gases in a storage area.

In accordance with the present invention, method and apparatus are provided for providing heat to liquefied gases being withdrawn from storage by combining hot compressed gases with the liquefied gases being withdrawn from storage. The hot compressed gases are diverted from the refrigeration system for the liquefied gases storage system. This results in a substantial decrease in the energy required to heat the liquefied gases flowing from the storage system and also prevents the build up of the lighter components of the liquefied gases in the storage system. The mixing of the hot compressed gases with the liquefied gases flowing from the storage system also results in a decrease in the refrigeration requirements for the storage area.

Other objects and advantages of the invention will be apparent from the foregoing brief description of the invention and the claims as well as the detailed description of the drawing in which:

The drawing is a diagrammatic illustration of the liquefied gases storage system of the present invention.

The invention is described in terms of a storage system for liquid propane. However, the invention is applicable to storage systems for other liquefied gases such as butane, ammonia or liquefied natural gas.

Although the invention is illustrated and described in terms of a specific liquefied gas storage system and a specific control system for the liquefied gas storage system, the invention is also applicable to different types and configurations of liquefied gas storage systems as well as different types of control system configurations which accomplish the purpose of the invention. Lines designated as signal lines in the drawings are electrical or pneumatic in this preferred embodiment. However, the invention is also applicable to mechanical, hydraulic or other signal means for transmitting information. In almost all control systems some combination of these types of signals will be used. However, use of any type of signal transmission, compatible with the process and equipment in use is within the scope of the invention.

The analog controllers shown may utilize the various modes of control such as proportional, proportional-integral, proportional-derivative, or proportional-integral-derivative. In this preferred embodiment, proportional-integral controllers are utilized but any controller capable of accepting two input signals and producing a scaled output signal, representative of a comparison of the two input signals, is within the scope of the invention. The operation of proportional-integral controllers is well known in the art. The output control signal of a proportional-integral controller may be represented as $$S=K_1E+K_2\int Edt$$

where

S=output control signals;

E=difference between two input signals; and $K_1$ and $K_2$=constants.

The scaling of an output signal by a controller is well known in control systems art. Essentially, the output of a controller may be scaled to represent any desired factor or variable. An example of this is where a desired temperature and an actual temperature are compared by a controller. The output could be a signal representative of a desired change in the flow rate of some gas necessary to make the desired and actual temperature equal. On the other hand, the same output signal could be scaled to represent a percentage or could be scaled to represent a pressure change required to make the desired and actual temperatures equal. If the controller output can range from 3 to 15 lbs., which is typical for a pneumatic controller, then the output signal could be scaled so that an output signal of 9 lbs. corresponds to 50 percent, some specified flow rate, or some specified pressure.

The various transducing means used to measure parameters which characterize the process and the various signals generated thereby may take a variety of forms or formats. For example, the control elements of the system can be implemented using electrical analog, digital electronic, pneumatic, hydraulic, mechanical or other types of equipment or combinations of one or more of such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of a particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameters, and still other transducing means may produce a signal which bears a more complicated, but known, relationship to the measured parameters. In addition, all signals could be translated into a "suppressed zero" or other similar format in order to provide a "live zero" and prevent an equipment failure from being erroneously interpreted as a "low" or "high" measurement or control signal. Regardless of the signal format or the exact relationship of the signal to the parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to the drawing, there is illustrated a storage tank 11 which contains liquefied propane. The storage tank 11 may be a large storage tank or may be a sealed underground cavern or other similar storage area. Generally, the liquid propane is maintained at about −55° F. at a pressure of about 12.5 psia. The liquefied gas in the storage area 11 will principally be propane but will also generally contain other gases such as ethane.

Vapors from the storage tank 11 are withdrawn through conduit means 12 and are provided to the suction inlet of the compressor 13. The thus withdrawn vapors are compressed and are provided from the discharge outlet of the compressor 13 through conduit means 15 to the three-way motor actuated control valve 17. The compressed vapors can flow from the three-way motor controlled valve 17 through conduit means 18 or conduit means 19. Generally, the three-way motor actuated control valve 17 is open for flow to conduit means 18 and is blocked for flow to conduit means 19. Compressed gaseous vapors are provided through conduit means 18 to the heat exchanger 16. The heat exchanger 16 is provided with a cooling fluid through conduit means 21. The thus cooled compressed fluid is provided through conduit means 23 to the accumulator 24. The gaseous portion of the fluid flowing through conduit means 23 may be withdrawn from an overhead section of the accumulator 24 through conduit means 25. The liquid portion of the fluid flowing through conduit means 23 is removed from a lower portion of the accumulator 24 and is provided through conduit means 26 to the storage tank 11. Typically, about 40 percent of the fluid flowing through conduit means 26 will flash upon entry into the storage tank 11 which results in a cooling of the remaining about 60 percent of the fluid flowing through conduit means 26 to about −55° F.

Liquefied gases are withdrawn from the storage tank 11 through conduit means 31 and are provided to the pump 32. From the pump 32, the liquefied gases are provided through the combination of conduit means 34 and 35 to the heat exchanger 38. The heat exchanger 38 is provided with a heating fluid flowing through conduit means 39. The fluid from the heat exchanger 38 is removed through conduit means 41 as a product stream.

Carbon steel loading lines and storage tanks are commonly utilized to handle the withdrawn liquefied gases. At below about 22° F., carbon steel starts to lose its strength. At −55° F., carbon steel becomes brittle. Preferably, the fluid flowing through conduit means 41 is heated to a temperature of about 22° F. to prevent damage to carbon steel loading lines or storage tanks.

When liquefied gases are being removed from the storage tank 11, the three-way motor actuated control valve 17 is manipulated in such a manner that at least a portion of the hot compressed gases flowing through conduit means 15 are diverted through conduit means 19 and are mixed with the liquefied gases flowing through conduit means 34. This provides heating of the liquefied gases flowing through conduit means 34 and also prevents the build up of the light components of the gases stored in the storage tank 11. Also, the fact that the vapors are not returned to the storage tank 11 results in a reduced refrigeration requirement for the storage tank 11 because the liquefied gases in the storage tank 11 can evaporate which results in a cooling of the liquefied gases in the storage tank 11. Preferably, the hot compressed gases flowing through conduit means 19 are utilized to raise the temperature of the liquefied gases flowing through conduit means 34 to about −5° F. The heating fluid flowing through conduit means 39 is then utilized to raise the temperature of the fluid flowing through conduit means 41 to about 22° F.

When it is desired to remove liquefied gases from the storage tank 11, pump 32 is actuated by setting the control switch 44 to a position which will supply power to the pump 32. At the same time, power is supplied to the motor associated with the three-way actuated controlled control valve 17. Both the pump 32 and the motor of the three-way motor actuated control valve 17 are connected to a power source (not illustrated) through the wire 45 and the control switch 44. The control switch 44 may be any suitable type of electronic switch.

When power is supplied to the motor associated with the three-way motor actuated control valve 17, the three-way motor actuated control valve 17 is manipulated in such a manner that the effluent flowing through conduit means 15 is split between conduit means 18 and 19. The pneumatic control valve 46, which is operably located in conduit means 19, is utilized to manipulate the flow of the hot compressed gases through conduit means 19. The portion of the hot compressed gases flowing through conduit means 15, which do not flow through conduit means 19, are provided through conduit means 18 to the heat exchanger 16 and are utilized as has been previously described.

Temperature transducer 51 in combination with a temperature measuring device such as a thermocouple, which is operably located in conduit means 35, provides an output signal 52 which is representative of the temperature of the fluid flowing through conduit means 35. Signal 52 is provided from the temperature transducer 51 to the temperature controller 53. The temperature controller 53 is provided with a set point signal 55 which is preferably equal to about −5° F. The temperature controller 53 provides an output signal 56 which is responsive to the difference between signals 52 and 55. Signal 56 is scaled so as to be representative of the flow rate of the hot compressed gases flowing through conduit means 19 required to maintain the temperature of the fluid flowing through conduit means 35 at about −5° F. Signal 56 is provided from the temperature controller 53 as the set point input to the flow controller 58.

Flow transducer 59 in combination with the flow sensor 61, which is operably located in conduit means 19, provides an output signal 62 which is representative of the flow rate of the hot compressed gases flowing through conduit means 19. Signal 62 is provided from the flow transducer 59 as the process input to the flow controller 58. The flow controller 58 provides an output signal 64 which is responsive to the difference between signals 56 and 62. Signal 64 is provided as a control signal to the pneumatic control valve 46. Pneumatic control valve 46 is manipulated in response to signal 64 to thereby maintain the flow rate of the hot compressed gases flowing through conduit means 19 substantially equal to the flow rate represented by the set point signal 56 so as to maintain the temperature of the fluid flowing through conduit means 35 at about −5° F.

The flow through conduit means 19 could be manipulated directly in response to signal 56 if desired. However, the use of the flow controller 58 in conjunction with the measurement of the actual flow through conduit means 19 provides a closer control of the flow rate of the hot gaseous fluid flowing through conduit means 19 and also provides a faster response to a change in the flow rate of the hot gaseous fluid flowing through conduit means 19.

Temperature transducer 68 in combination with a temperature measuring device such as a thermocouple, which is operably located in conduit means 41, provides an output signal 69 which is representative of the temperature of the fluid flowing through conduit means 41. Signal 69 is provided as the process variable input to the temperature controller 63. The temperature controller 63 is also provided with a set point signal 70 which is preferably representative of about 22° F. The temperature controller 63 provides an output signal 66 which is responsive to the difference between signals 69 and 70. Signal 66 is provided as a control signal to the pneumatic control valve 67 which is operably located in conduit means 39. Signal 66 is scaled so as to be representative of the valve position of the pneumatic control valve 67 which is required to maintain the temperature of the fluid flowing through conduit means 41 substantially equal to the temperature represented by the set point signal 70. The pneumatic control valve 67 is manipulated in response to signal 66 to thereby manipulate the flow rate of the heating fluid flowing through conduit means 39 so as to maintain the temperature of the fluid flowing through conduit means 41 substantially equal to the temperature represented by the set point signal 70.

If desired, the three-way motor actuated control valve 17 may be manipulated in such a manner that flow through conduit means 18 is blocked and all of the hot compressed gases flowing through conduit means 15 flow through conduit means 19. The pneumatic control valve 46 may be removed and the control system associated with the pneumatic control valve 46 may be removed. This provides for maximum usage of the hot compressed gases flowing through conduit means 15. The temperature control based on the measurement of the temperature of the effluent flowing through conduit means 41 would be utilized to raise the temperature of the fluid flowing through conduit means 35 the extent necessary to insure that the temperature of the fluid flowing through conduit means 41 is about 22° F.

Control of the flow of gases from the accumulator 24 is accomplished by utilizing pressure transducer 71 to provide an output signal 72 which is representative of the actual pressure in the accumulator 24. Signal 72 is provided as the process variable input to the pressure controller 73. The pressure controller 73 is also provided with a set point signal 75 which is representative of the desired pressure in the accumulator 24. Preferably, signal 75 is representative of about 225 psia. Pressure controller 73 provides an output signal 77 which is responsive to the difference between signals 72 and 75. Signal 77 is provided as a control signal to the pneumatic control valve 78 which is operably located in conduit means 25. The pneumatic control valve 78 is manipulated in response to signal 77 to thereby maintain the pressure in the accumulator 24 substantially equal to the pressure represented by the set point signal 75.

The flow of fluid from the accumulator 24 is controlled by utilizing the level controller 81 to provide an output signal 82 which is scaled so as to be representative of the desired flow rate of fluid from the accumulator 24. The flow of fluid from the accumulator 24 is controlled so as to maintain a desired fluid level in the accumulator 24. Signal 82 is provided as a control signal to the pneumatic control valve 84 which is operably located in conduit means 26. The pneumatic control valve 84 is manipulated in response to signal 82 to thereby maintain a desired fluid level in the accumulator 24.

The following calculated example of typical process conditions for the liquid propane storage system illustrated in FIG. 1 is provided to further illustrate the present invention. For the sake of convenience, the calculated example assumes a total diversion of the hot compressed gases flowing through conduit means 15 to conduit means 19.

| | |
|---|---|
| Liquid Propane in Storage Tank 11: | |
| Pressure, psia, | 12.5 |
| Temperature, °F., | −55 |
| Volume Liquid Propane in Storage, Gallons, | 6,000,000 |
| Vapor to Compressor 13: | |
| (a) Pounds/hour, | 6,000 |
| Temperature, °F., | −55 |
| Pressure, psia., | 12 |
| Vapor from Compressor 13: | |
| Pounds/hour, | 6,000 |
| Temperature, °F., | 170 |
| Pressure, psia., 230 | |
| Propane Liquid Flowing Through Conduit Means 34: | |
| Gallons/minute, (measured at −55° F.) | 200 |
| Temperature, °F., | −55 |
| Pressure, psia., | 12.5 |
| Compressor Vapor Flowing Through Conduit Means 19: | |
| Pounds/hour | 6,000 |
| Temperature, °F., | 170 |
| Pressure, psia., | 230 |
| Propane Liquid Flowing Through Conduit Means 35: | |
| Gallons/hour, (measured at −5° F.) | 230 |
| Temperature, °F., | −5 |
| Liquid Flowing Through Conduit Means 41: | |
| Gallons/hour, (measured at 22° F.) | 240 |
| Temperature, °F., | (b) 22 |
| Pressure, psia., | (c) |

(a) Depends upon refrigeration requirements and amount of liquid propane dispensed;
(b) Minimum is 22° F. so as to not damage downstream carbon steel equipment;
(c) Summer pressure will be about 170 psig.; winter pressure will be about 60 psig. (depends upon temperature of receiving unit).

For the foregoing process conditions, the present invention results in an energy saving of approximately 1,000,000 BTU per hour of outside heat normally required for the heat exchanger 38. The present invention further provides an approximately 40 percent decrease in the refrigeration requirements of the storage tank 11.

The invention has been described in terms of a preferred embodiment as is illustrated in FIG. 1. Specific components which can be used in the practice of the invention as illustrated in FIG. 1 such as the three-way motor actuated control valve 17, pneumatic control valves 46, 67, 78, and 84; flow sensor 61; flow transducer 59; temperature transducers 51 and 68; pressure transducer 72; temperature controllers 53 and 63; flow controller 58; pressure controller 73; and level controller 81 are each well known, commercially available control components such as are described at length in *Perry's Chemical Engineer's Handbook,* 4th edition, chapter 22, McGraw-Hill.

While the invention has been described in terms of the presently preferred embodiment, reasonable variations and modifications are possible by those skilled in the art, within the scope of the described inventions and the appended claims.

That which is claimed is:

1. Apparatus comprising:

a storage means for liquefied gases;

means for withdrawing liquefied gases from said storage means;

a compressor means having a suction inlet and a discharge outlet;

means for withdrawing a vapor stream from said storage means and for providing said vapor stream to the suction inlet of said compressor means; and means for withdrawing the compressed gases from the discharge outlet of said compressor means and for mixing at least a portion of said compressed gases with the liquefied gases withdrawn from said storage means to thereby supply heat to the liquefied gases withdrawn from said storage means.

2. Apparatus in accordance with claim 1 wherein said means for withdrawing compressed gases from the discharge inlet of said compressor means and for mixing at least a portion of said compressed gases with the liquefied gases withdrawn from said storage means comprises:

a three-way control valve means having first, second and third ports;

first conduit means extending from the discharge outlet of said compressor means to the first port of said three-way control valve means;

second conduit means extending from the second port of said three-way control valve means to said means for withdrawing liquefied gases from a lower portion of said storage means;

a first heat exchange means;

third conduit means extending from the third port of said three-way control valve means to said heat exchanger means; and means for manipulating said three-way control valve means in such a manner that all of the compressed gases flowing through said first conduit means flows to said first heat exchange means if no liquefied gases are being withdrawn from said storage means and at least a portion of said compressed gases flowing through said first conduit means flow through said second conduit means if liquefied gases are being withdrawn from said storage means.

3. Apparatus in accordance with claim 2 additionally comprising:

means for establishing a first signal representative of the temperature of the combined stream of said compressed gases and the liquefied gases withdrawn from said storage means;

means for establishing a second signal representative of the desired temperature of said combined stream;

means for comprising said first signal and said second signal and for establishing a third signal responsive to the difference between said first signal and said second signal; and means for manipulating the flow rate of the compressed gases flowing through said second conduit means in response to said third signal.

4. Apparatus in accordance with claim 3 wherein said means for manipulating the flow rate of the compressed gases flowing through said second conduit means in response to said third signal comprises:

means for establishing a fourth signal representative of the actual flow rate of the compressed gases flowing through said second conduit means;

means for comparing said fourth signal and said third signal and for establishing a fifth signal responsive to the difference between said third signal and said fourth signal;

a control valve means operably located in said second conduit means; and means for manipulating said control valve means in response to said fifth signal to thereby maintain the temperature of said combined stream substantially equal to the desired temperataure for said combined stream.

5. Apparatus in accordance with claim 4 additionally comprising:

a second heat exchanger means;

means for providing a heating fluid to said second heat exchanger means;

means for providing said combined stream to said second heat exchanger means;

means for withdrawing the heated said combined stream as a product stream from said second heat exchanger means;

means for establishing a sixth signal representative of the temperature of said product stream;

means for establishing a seventh signal representative of the desired temperature of said product stream;

means for comparing said sixth signal and said seventh signal and for establishing an eighth signal responsive to the difference between said sixth signal and said seventh signal; and means for manipulating the flow rate of said heating fluid to said second heat exchanger means in response to said eighth signal to thereby maintain the actual temperature of said product stream substantially equal to the desired temperature of said product stream.

6. Apparatus in accordance with claim 5 additionally comprising:

a separator means;

means for supplying the fluid flowing from said first heat exchanger means to said separator means; and means for withdrawing liquid from said separator means and for supplying the thus withdrawn liquid to an upper portion of said storage means.

7. A method for supplying heat to liquefied gases withdrawn from a storage system for liquefied gases comprising the steps of:

withdrawing a vapor stream from said storage system for liquefied gases;

compressing said vapor stream to form compressed gases; and mixing at least a portion of said compressed gases with the liquefied gases withdrawn from said storage system to thereby supply heat to the liquefied gases withdrawn from said storage system.

8. A method in accordance with claim 7 wherein all of said compressed vapors are mixed with the liquefied gases withdrawn from said storage system.

9. A method in accordance with claim 7 additionally comprising the steps of:

establishing a first signal representative of the temperature of the combined stream of said compressed gases and the liquefied gases withdrawn from said storage system;

establishing a second signal representative of the desired temperature of said combined stream;

comparing said first signal and said second signal and establishing a third signal responsive to the difference between said first signal and said second signal; and manipulating the rate at which said compressed gases are mixed with the liquefied gases withdrawn from said storage system in response to said third signal to thereby maintain the actual temperature of said combined stream substantially equal to the desired temperature for said combined stream.

10. A method in accordance with claim 9 wherein said step of manipulating the rate at which said compressed gases are mixed with the liquefied gases withdrawn from said storage system in response to said third signal comprises:

establishing a fourth signal representative of the actual flow rate of the compressed gases which are being mixed with the liquefied gases withdrawn from said storage system;

comparing said fourth signal and said third signal and establishing a fifth signal responsive to the difference between said third signal and said fourth signal; and manipulating the flow rate of the compressed gases being combined with the liquefied gases withdrawn from said storage system in response to said fifth signal to thereby maintain the temperature of said combined stream substantially equal to the desired temperature for said combined stream.

11. A method in accordance with claim 10 additionally comprising the steps of:

heating said combined stream to produce a product stream;

establishing a sixth signal representative of the temperature of said product stream;

establishing a seventh signal representative of the temperature of said product stream;

comparing said sixth signal and said seventh signal and establishing an eighth signal responsive to the difference between said sixth signal and said seventh signal; and manipulating the rate at which said combined stream is heated in response to said eighth signal to thereby maintain the actual temperature of said product stream substantially equal to the desired temperature of said product stream.

* * * * *

UNITED STATES PATENT AND TRADEMARK OFFICE

CERTIFICATE OF CORRECTION

PATENT NO. : 4,276,749

DATED : July 7, 1981

INVENTOR(S) : Ralph P. Crowley

It is certified that error appears in the above-identified patent and that said Letters Patent are hereby corrected as shown below:

Column 7, claim 2, line 54, after "heat", delete "exchanger" and insert "exchange".

Column 8, claim 3, line 6, after "means for", delete "comprising" and insert --- comparing ---.

Column 8, claim 4, line 30, after "desired", delete "temperataure" and insert --- temperature ---.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*